US005098057A

United States Patent [19]

Gran et al.

[11] Patent Number: 5,098,057

[45] Date of Patent: Mar. 24, 1992

[54] SHAFT ANCHORING APPARATUS

[76] Inventors: Carl H. Gran, 2610 64th St. SW., Naples, Fla. 33999; Charles Reed, 129 Johnson Ct., Naples, Fla. 33942; Arthur A. Smith, 176 Cape Sable Dr., Naples, Fla. 33942

[21] Appl. No.: 642,083

[22] Filed: Jan. 16, 1991

Related U.S. Application Data

[63] Continuation-in-part of Ser. No. 421,746, Oct. 16, 1989, abandoned.

[51] Int. Cl.[5] ..... E02D 5/74

[52] U.S. Cl. ..... 248/530; 248/156; 248/545; 52/157

[58] Field of Search ..... 248/530, 545, 156, 533, 248/532; 52/165, 157, 155, 156, 158

[56] References Cited

U.S. PATENT DOCUMENTS

| | | | |
|---|---|---|---|
| 3,344,551 | 10/1967 | Chestnut | 248/156 |
| 4,455,795 | 6/1984 | Cole | 52/165 |

FOREIGN PATENT DOCUMENTS

| | | | |
|---|---|---|---|
| 1224360 | 6/1960 | France | 52/156 |
| 67059 | 12/1913 | Switzerland | 52/157 |
| 703783 | 2/1954 | United Kingdom | 52/158 |

*Primary Examiner*—Alvin C. Chin-Shue
*Attorney, Agent, or Firm*—Merrill N. Johnson

[57] ABSTRACT

Apparatus for reliably anchoring a vertical shaft to various types of earth. The apparatus includes an anchor pin having a helically coiled portion at the lower end thereof designed to be screwed into the ground, and a shaft holder releasably attached to the anchor pin and having a shaft-receiving opening through which a shaft carrying a load to be anchored is adapted to be extended. The shaft-receiving opening is laterally offset from its attachments to the anchor pin such that the shaft may be extended fully through the opening and firmly inserted into the ground. The anchoring apparatus of the invention is designed for general use in anchoring vertical shafts carrying various types of loads including umbrellas, birdhouses, signs, flags and the like.

5 Claims, 2 Drawing Sheets

SHAFT ANCHORING APPARATUS

This application is a continuation-in-part of our earlier application Ser. No. 07/421,746 filed Oct. 16, 1989, now abandoned.

BACKGROUND OF THE INVENTION

The present invention relates generally to an apparatus for anchoring a shaft to the ground, and more particularly, to an apparatus for reliably anchoring a vertical shaft to various types of earth.

Commonly assigned U.S. Pat. No. 4,920,897 discloses a beach and lawn table which is affixed to the ground on which it rests by means of an auger attached to and extending downwardly from the base of the table. The table has a single axially located leg. A table top is mounted on the upper end of the leg and the base from which the auger extends is attached to the lower end of the leg. The table is anchored to the ground by turning the table top until the auger is fully screwed into the ground and the base rests firmly on the ground. The single leg is preferably hollow to additionally function as a holder for the shaft of an umbrella for the table.

The auger attached to and extending downwardly from the base of the beach and lawn table disclosed in U.S. Pat. No. 4,920,897 provides a secure and reliable anchor for the table. It is desirable, however, to provide an anchoring apparatus for general use which can support and reliably anchor vertical shafts which carry various types of loads such as signs, flags, birdhouses, umbrellas and the like. Beach umbrellas, in particular, present a significant problem in this regard because they must be anchored into relatively soft sand and, at the same time, be able to withstand the high winds frequently encountered at the beach which make it especially difficult to retain the umbrellas in position. A wind-blown beach umbrella is not only a frustrating nuisance to the user, but is also dangerous as it can become a moving projectile weighing four pounds or more and endanger both persons and property in its path.

SUMMARY OF THE INVENTION

The present invention provides an anchoring apparatus which can be used to reliably anchor beach umbrellas and numerous other articles carried on a vertical shaft to various types of earth. The anchoring apparatus according to the invention comprises an anchor pin having a helical portion at its lower end designed to be screwed into the ground, and an extended portion designed to extend upwardly from the ground to form a handle used to screw the helical portion into the ground; and a shaft holder attached to the upper portion of the anchor pin which extends somewhat laterally therefrom, the shaft holder including a body portion for defining a substantially vertical shaft-receiving opening laterally offset from the anchor pin through which a shaft to be supported is adapted to extend, and locking means for releasably locking the shaft in position in the shaft-receiving opening.

In accordance with the invention, the anchor pin is anchored to the ground by screwing the helical portion thereof into the ground. A shaft to be supported by the apparatus is then extended through the shaft-receiving opening in the body portion of the shaft holder and then locked in position therein by the locking means. Because the shaft-receiving opening is closely adjacent to the anchor pin, the shaft can be extended through the shaft-receiving opening into the ground until the tip of the shaft passes through at least the uppermost coil of the buried helical portion of the anchor pin before being locked in position by the locking means to provide a strong, reliable anchor of the vertical shaft to the ground.

Preferably the anchor pin is made from a single steel rod having a helically coiled auger portion at its lower end designed to be screwed into the ground, a vertically extending middle portion and its upper end formed into a handle for screwing the helically coiled lower end into the ground. The shaft holder includes a pair of spaced flanges extending outwardly from a side of the body portion to receive the upstanding vertical portion of the anchor pin therebetween. A clench screw extends through aligned holes in the flanges and is adapted to be tightened by a wing nut to firmly attach the shaft holder to the anchor pin and to stabilize the shaft holder both vertically and orbitally with respect to the anchor pin.

The locking means preferably comprises a threaded boss on the outside and extending through the body of the shaft holder and a mating wing bolt which adjusts to the diameter of the shaft and by exerting pressure against the shaft locks the shaft in position in the opening.

The anchoring apparatus of the present invention is effective in anchoring vertical shafts supporting loads of diverse types in various types of earth including sand and other soft earths in a reliable manner. The apparatus is compact in size for easy handling and storage, and easy to use. The apparatus may be produced in a range of sizes to support vertical shafts of diverse type carrying varied loads.

Further advantages and specific details of the invention will become apparent hereinafter in conjunction with the following detailed description of a preferred embodiment.

DETAILED DESCRIPTION OF THE PREFERRED EMBODIMENT

FIGS. 1–4 illustrate a shaft anchoring apparatus according to a preferred embodiment of the invention. The apparatus is generally designated by reference number 10 and is illustrated in conjunction with an umbrella 11 having an umbrella shaft 11*a* to be anchored thereby. It should be understood, however, that the umbrella is intended to be exemplary only of the numerous types of articles which can be anchored by the apparatus of the present invention, and it is not intended to limit the apparatus to use with any particular article. For example, the apparatus of the invention can also be effectively used to anchor vertical shafts carrying loads such as flags, signs, birdhouses and the like.

The anchoring apparatus generally comprises an anchor pin 12 and a shaft holder 13 which are connected together to form an integrated product. Anchor pin 12 includes a helical auger portion 12*c* at the lower end thereof, a handle portion 12*a* at the upper end thereof, and a substantially straight stem portion 12*b* extending between the helical portion and the handle portion. Helical portion 12*c* is designed to be screwed into the ground and includes a taper-rounded tip 12*d* to provide easy insertion thereinto. Handle portion 12*a* is provided to facilitate screwing of the helical portion into the ground by the user and can be of any suitable configuration. Stem portion 12*b* is provided with a washer 12*e* welded to the stem for attachment of the anchor pin to the shaft holder 13 as will be explained hereafter.

Figure 1:
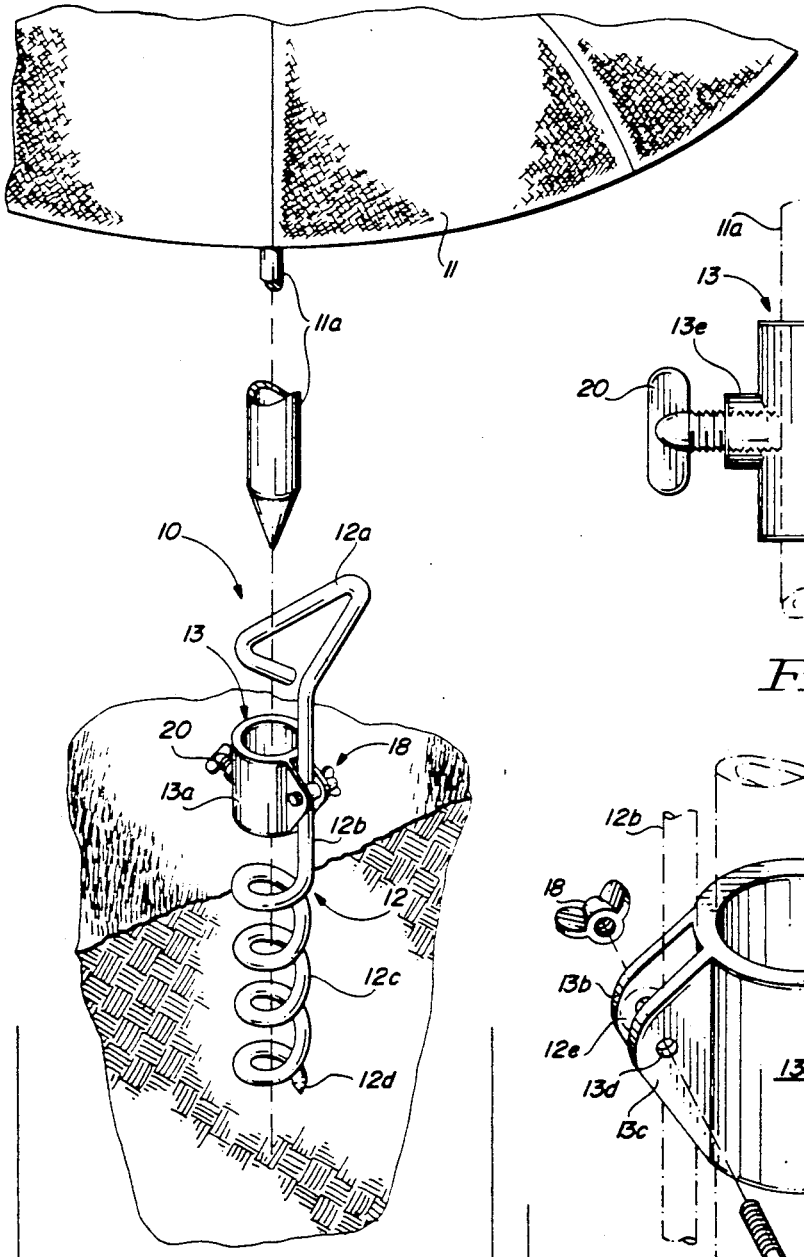
FIG. 1 illustrates a shaft anchoring apparatus according to a preferred embodiment of the invention, and an umbrella to be anchored thereby.

As shown in FIG. 1, when helical portion 12*c* is screwed into the ground, the handle portion 12*a* and the stem portion 12*b* of the anchor pin define an extended portion extending upwardly from the ground.

Shaft holder 13 includes a cylindrical main body portion 13*a* for defining a substantially vertical opening 13*h* for receiving a vertical shaft to be anchored by the apparatus such as the umbrella shaft 11*a* shown in FIG. 1. Shaft holder 13 includes internally threaded boss 13*e* and wing bolt 20 for releasably locking a shaft in a fixed position in the shaft-receiving opening 13*h* and also means for attaching the shaft holder to the anchor pin now to be described.

Figure 2:
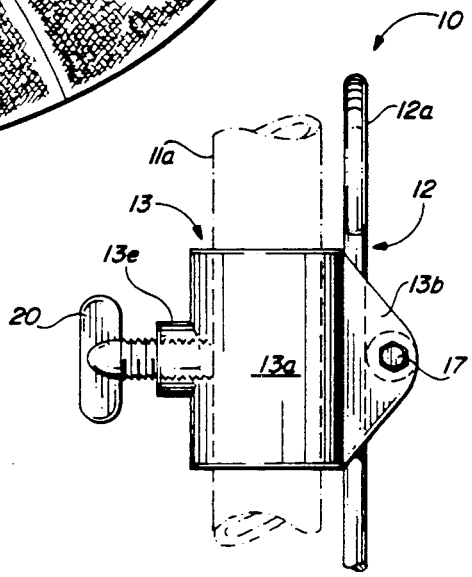
FIG. 2 is a side view of a portion of the apparatus of FIG. 1.
Figure 3:
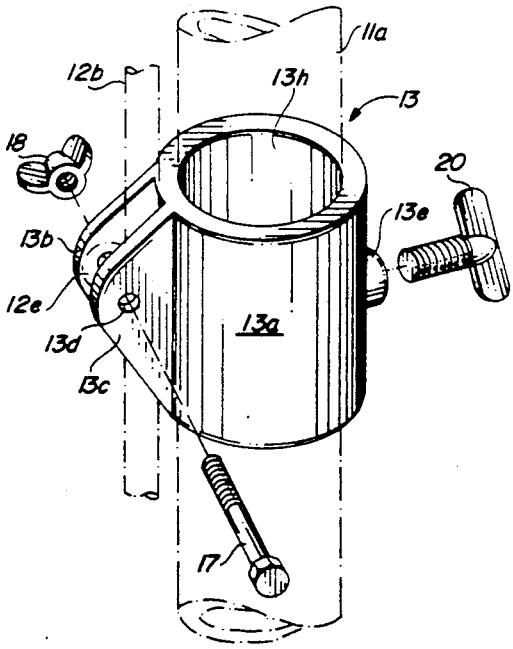
FIG. 3 is a partially exploded view of the shaft holder of the apparatus of FIG. 1.
Figure 4:
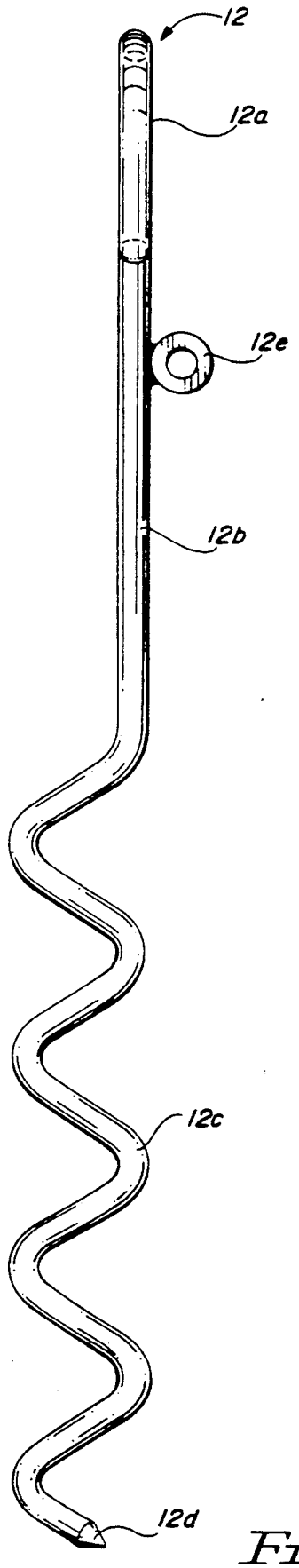
FIG. 4 is a side view of a preferred form of the anchor pin.

As shown in FIGS. 2 and 3, shaft holder 13 includes a pair of parallel flanges 13*b* and 13*c* extending outwardly from a side wall thereof containing axially aligned cylindrical holes 13*d* in the flanges. The pair of spaced flanges 13*b* and 13*c* extend from the side wall of main body portion 13*a* opposite boss 13*e*.

As best shown in FIG. 3, the stem portion 12*b* and welded washer 12*e* of anchor pin 12 are designed to be received between flanges 13*b* and 13*c*, and the anchor pin is attached to the shaft holder by a gripping screw 17 which extends through the hole in washer 12*e* and aligned holes 13*d* in the flanges. More particularly, flanges 13*b* and 13*c* are spaced to normally receive stem portion 12*b* and washer 12*e* therebetween with a slight clearance to permit the hole in washer 12*e* to be aligned with the holes 13*d* in the flanges. After alignment, the gripping screw 17 is inserted and tightened by turning wing nut 18 to squeeze the flanges together until the anchor pin is tightly secured to the shaft holder.

As best shown in FIG. 1, washer 12*e* is welded onto anchor pin stem 12*b* so that the axis of the coils of the helical portion 12*c* of the anchor pin will be axially aligned with the axis of the cylindrical main body 13*a* of the shaft holder. This permits the tip of the load carrying shaft such as umbrella shaft 11*a* shown in FIG. 1 to be inserted into the ground and preferably pass through at least the uppermost coil of helical portion 12*c* of the anchor pin in order to further secure a strong anchor of the vertical shaft into the ground.

To use the shaft anchoring apparatus of our invention, anchor pin 12 is first anchored to the ground at a selected location by grasping the handle portion 12*a* and turning the anchor pin until the helical portion 12*c* thereof is fully screwed into the ground. With the wing bolt 20 withdrawn from the interior of shaft holder 13, a shaft such as umbrella shaft 11*a* carrying a load to be supported is then inserted into and through the shaft-receiving opening 13*h* in the shaft holder 13. Preferably the tip of the shaft is inserted into the ground for a sufficient distance so that the tip of the shaft lies below the uppermost coil of the helical portion of the anchor pin so that the lowermost portion of the shaft lies within the coils of the anchor pin for maximum support of the shaft in its vertical position. When the shaft is in its lowermost position, wing bolt 20 is then screwed into boss 13*e* and into firm engagement with the shaft to securely lock the shaft into position within shaft holder 13 and anchor pin 12.

Following use of the apparatus, the shaft can be easily removed from the apparatus by simply unscrewing wing bolt 20 and pulling the shaft out of the ground. The apparatus itself can be easily withdrawn from the ground by rotating the anchor pin in the direction opposite to that used in screwing the pin into the ground.

The anchoring apparatus of the present invention is highly effective in anchoring the supporting vertical shafts in various kinds of earth, including soft sand and the like. The apparatus can be readily operated by one person and is compact in size for easy handling and storage.

While what has been described constitutes a presently preferred embodiment, it should be recognized that the invention could take numerous other forms. Accordingly, it should be understood that the invention is to be limited only by the scope of the following claims.

We claim:

1. Anchoring apparatus for anchoring a vertical shaft to the ground comprising an anchor pin made from a single steel rod having a helically coiled portion at its lower end designed to be screwed into the ground, and having its upper end designed to extend vertically upwardly from the ground and then being formed into a handle to aid in screwing the helically coiled portion of the anchor pin into the ground; and a shaft holder releasably attached to the vertically extending portion of the upper end of the anchor pin and the shaft holder including a body portion having a vertical shaft-receiving opening laterally offset from said vertically extending portion and axially aligned with a central axis of the helically coiled portion of the anchor pin through which a shaft to be supported is adapted to extend and locking means on the shaft holder for releasably locking the shaft in position within said shaft-receiving opening.

2. Apparatus as set forth in claim 1 wherein the means for releasably attaching the shaft holder to the anchor pin includes a pair of spaced apart flanges on the body portion of the shaft holder for receiving therebetween the vertically extending upper end of the anchor pin and means for gripping said anchor pin between the pair of flanges.

3. Apparatus as set forth in claim 1 wherein the locking means for releasably locking the shaft in position includes an internally threaded boss on the body of the shaft holder and a wing bolt threaded into the internally threaded boss and designed to be screwed against the shaft passing through the shaft holder so as to lock the shaft into a fixed position.

4. Anchoring apparatus for anchoring a vertical shaft to the ground comprising an anchor pin made from a single steel rod having a helically coiled portion at its lower end designed to be screwed into the ground, and having its upper end designed to extend vertically upwardly from the ground and then being formed into a handle to aid in screwing the helically coiled portion of the anchor pin into the ground, and a shaft holder releasably attached to the vertically extending portion of the upper end of the anchor pin and the shaft holder including a body portion having a vertical shaft-receiving opening axially aligned with the helically coiled portion of the anchor pin through which a shaft to be supported is adapted to extend and locking means on the shaft holder for releasably locking the shaft in position within said shaft-receiving opening.

wherein a metal washer is welded to the vertically extending portion of the anchor pin and the means for releasably attaching the shaft holder to the anchor pin includes a pair of spaced apart flanges on the body portion of the shaft holder for receiving therebetween the vertically extending portion of the anchor pin and the washer welded thereto, the flanges containing axially aligned holes designed to be aligned with the hole in the washer lying between the two flanges, and a gripping screw designed to pass through the aligned holes in the two flanges and the washer and be tightened by a wing nut to squeeze the flanges together and lock the anchor pin and the shaft together in fixed position.

5. Anchoring apparatus for anchoring a vertical shaft carrying a load into the ground comprising an anchor pin made from a single cylindrical metal rod having a helically coiled portion at its lower end designed to be screwed into the ground, a handle portion at its upper end to facilitate screwing its helically coiled lower end into the ground, and a straight vertically extending portion between its helical lower end and its handle portion;

a shaft holder including a cylindrical main body portion having a vertical shaft-receiving opening through which a shaft to be anchored is to be inserted allowing up and down movement therein;

locking means mounted on the main body portion of the shaft holder for locking the shaft in fixed position in the shaft receiving opening; and attaching means for attaching the vertically extending portion of the anchor pin to the shaft holder with the vertically extending portion of the anchor pin parallel to and laterally offset from the axis of the shaft-receiving opening in the body of the shaft holder and said opening axially aligned with a central axis of the helically coiled portion.

* * * * *